United States Patent [19]

Jordan

[11] Patent Number: 4,942,962

[45] Date of Patent: Jul. 24, 1990

[54] FREE STANDING GOLF BAG APPARATUS

[76] Inventor: Rodney B. Jordan, P.O. Box 39, Florien, La. 71429

[21] Appl. No.: 394,245

[22] Filed: Aug. 7, 1989

Related U.S. Application Data

[63] Continuation-in-part of Ser. No. 272,344, Nov. 17, 1988, abandoned.

[51] Int. Cl.[5] ..... A63B 55/00

[52] U.S. Cl. ..... 206/315.7; 248/156

[58] Field of Search ..... 206/315.7, 315.6; 248/156, 96

[56] References Cited

U.S. PATENT DOCUMENTS

| | | | |
|---|---|---|---|
| 1,452,084 | 4/1923 | Luckett | 206/315.7 |
| 1,488,389 | 3/1924 | Hibbert | 206/315.7 |
| 1,502,300 | 7/1924 | Fairchild | 206/315.7 |
| 1,596,231 | 8/1926 | Bennett | 206/315.7 |
| 1,715,101 | 5/1929 | Shanahan | 206/315.7 |
| 1,739,702 | 12/1929 | Wing | 206/315.7 X |
| 1,811,296 | 6/1931 | Boden et al. | 248/96 |
| 1,849,803 | 3/1932 | Pedersen | 206/315.7 |
| 2,857,957 | 10/1958 | Gay | 248/156 X |
| 4,071,062 | 1/1978 | Ianetta | 206/315.7 |

FOREIGN PATENT DOCUMENTS

| | | | |
|---|---|---|---|
| 182698 | 7/1922 | United Kingdom | 206/315.6 |
| 353218 | 7/1931 | United Kingdom | 248/156 |

*Primary Examiner*—William Price

*Attorney, Agent, or Firm*—Rod B. Jordan

[57] ABSTRACT

An apparatus for supporting and maintaining a golf club bag in a vertical position on natural turf, consisting essentially of a chassis, said chassis being removably, or permanently fixed to the bottom of a golf club bag, and a plurality of prongs protruding downward from the chassis, mounted to the chassis in a fixed, or pivotal manor. The golf club bag is supported by the prongs being driven into the turf.

9 Claims, 3 Drawing Sheets

FREE STANDING GOLF BAG APPARATUS

This invention relates to an apparatus for supporting, and maintaining a golf club bag in a vertical position while the golfer is making his shot. Golf has long been one of America's favorite sports. The enjoyment of playing the game can be complimented by the exercise that is gained by walking the course. In years past, the typical golfer was accompanied by his esquire, commonly referred to as a caddy. The caddy faithfully tended the golfer's arsensal of clubs so that the golfer had only to concentrate on his shot. Sadly today, due to high labor cost, and the advent of the golf cart, the faithful caddy has all but disappeared. There are those, however, who have shunned the ease and expense of the golf cart in preference to carrying their own bag of clubs. These hearty sportsmen continue to enjoy the exercise formerly associated with the sport of golf. There is, however, a problem that arises with this approach to the game, that is, what to do with the bag of unused clubs while making the shot. At present, the only remedy is to lie the bag of clubs upon the ground. This can cause damage to the clubs, and bag, especially if the bag is hurriedly put down. Having to bend over to lie down, and pick up a heavy bag of clubs can also cause back injury. In addition to this, the idea of lying ones prized set of golf clubs upon the ground is, to many golfers, beneath the class and diginity of the sport. Surely the ability to swiftly fix ones golf club bag in a secure vertical position will be cherished by every walking golfer.

The apparatus with which this invention deals consists essentially of a generally round disk, with several prongs projecting downward from the disk. The disk could be removably attached to the bottom of a golf club bag as an add on feature, or might even serve as the golf club bag bottom itself. The golf club bag equipped with this apparatus would then have a set of sod penetrating prongs projecting from its bottom end. These sod penetrating prongs would be pointing downward toward the ground when the golf club bag is in a vertical position. The sod penetrating prongs would be tapered so that they could penetrate the usually soft turf typical of golf courses, however, they need not be sharp enough to injure anyone. When the golfer reaches his lie, he would remove the appropriate club, and then secure his bag of remaining golf clubs in a vertical position, as if held there by a caddy, by simply setting the golf club bag down firmly on its end. The sod penetrating prongs would be driven partially into the turf. This would lend support to the golf club bag by the sod penetrating prongs being wedged into the turf, and by elevating the golf club bag slightly above the turf on one side or the other of the bottom plate, thus compensating for unlevel terrain. The golf club bag would then stand there securely while the golfer is making his shot. After the shot is made, the golfer would replace the club in use, and retrieve the golf club bag with a slight lifting motion from a standing position. By properly shaping the sod penetrating prongs, such as in a tapered channel shape, damage to the turf could be minimized.

The sod penetrating prongs could be fixed permanently in a downward position, or be mounted in a way that they could be folded, or recessed out of the way. This would allow the "free standing golf club bag apparatus" equipped bag to also be used with a golf cart. The sod penetrating prongs could be recessed into the disk from where they could be extended by a pull and twist to lock method. They could also be hinged to the bottom of the plate so that they could be folded out of the way while not in use. Spring loaded, two stop hinges could be used to hold each sod penetrating prong in a folded, or extended for use position. The sod penetrating prongs could be mounted within indentations in the disk so that they would be completely out of the way when not in use. The indentations in the disk could be so shaped that the vertical sides and ends of the indentations themselves could be used to mount the sod penetrating prongs, as well as hold them in the desired positions. The golf club bag could be equipped with a plurality of single prong support apparatus.

DETAILED DESCRIPTION

Figure 1:
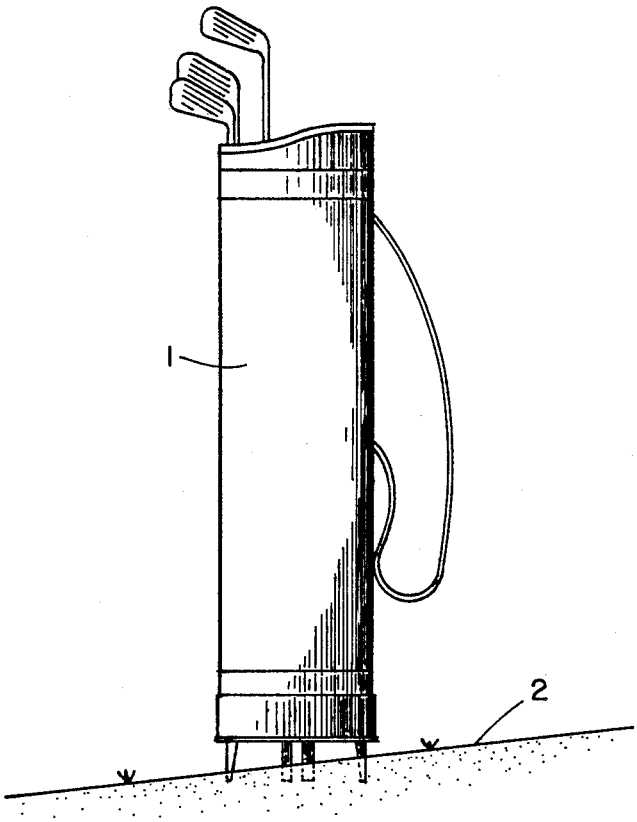
FIG. 1 is a side elevation of a golf club bag equipped with the free standing golf club bag apparatus, secured in a vertical position on natural turf.

Referring to FIG. 1, it can be seen that the golf club bag 1 is secured in a vertical free standing position on unlevel natural turf terrain 2. The golf club bag 1 is held in position by sod penetrating prongs 3, said sod penetrating prongs being wedged to various depths into natural turf terrain 2.

Figure 2:
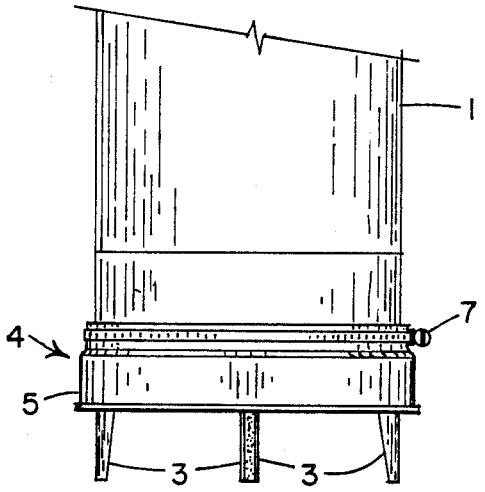
FIG. 2 is a side elevation of the free standing golf club bag apparatus, used as a removable model, attached to the bottom of a golf club bag.

Referring to FIG. 2, it can be seen that a golf club bag 1 is fitted with a detachable, free standing golf club bag apparatus 4 consisting primarily of a bottom plate 5, four sod penetrating prongs 3, a collar 6, and a screw clamp 7. The bottom end of the golf club bag 1 is inserted into the collar 6. The collar 6 is clamped to the bottom of the golf club bag 1 by screw type clamp 7. The collar 6 is tapered toward its top. It is also elastic. This allows one size collar to fit a range of golf club bags. The apparatus 4 could as well be glued, rather than clamped to the bottom of the gold club bag 1. The sod penetrating prongs 3 are pivotally, or rigidly attached to the bottom plate 5, and extended in a downward direction.

Figure 3:
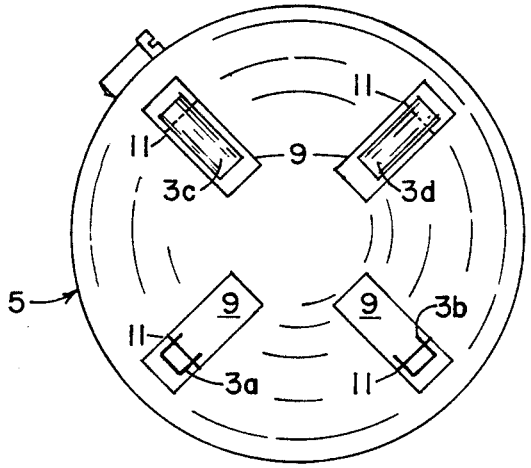
FIG. 3 is a bottom elevation of the free standing golf club bag apparatus.

Referring to FIG. 3, it can be seen that sod penetrating prongs 3*a*, 3*b*, 3*c*, and 3*d* are pivotally secured to bottom plate 5 of the free standing golf club bag apparatus, within indentations 9, formed into bottom plate 5. The sod penetrating prong 3, when folded toward the bottom plate 5, are retracted into indentations 9. Sod penetrating prongs 3*a*, and 3*b* are deployed ( folded outward ) perpendicular to bottom plate 5. Sod penetrating prongs 3*c*, and 3*d* are folded into a retracted position within indentations 9. The sod penetrating prongs depicted in FIG. 3 are made of "C" shaped, channel type material. Sod penetrating prongs 3*a*, 3*b*, 3*c*, and 3*d* are pivotally attached to bottom plate 5, by rods 11. Rods eleven pass through holes ( not illustrated ) in the outward flanges of each channel shaped sod penetrating prong, and seat into the vertical sides of indentations 9, so as to facilitate folding the sod penetrating prongs into and out of indentations 9. The top end of each sod penetrating prong is flat, and the top corners of the sod penetrating prongs are so shaped that a spring action exerted by either the surface of the bottom plate 5, or the rod 11, or both will hold the sod penetrating prongs in either a perpendicular, or parallel position with respect to the bottom plate 5.

Figure 4:
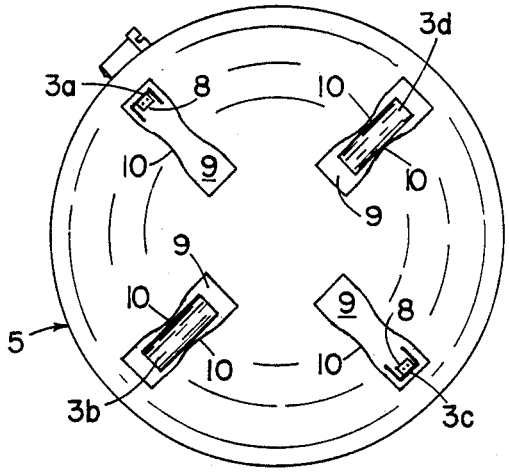
FIG. 4 is a bottom elevation of the free standing golf club bag apparatus.

Referring to FIG. 4, it can be seen that four sod penetrating prongs 3*a*, 3*b*, 3*c*, and 3*d* are pivotally attached to the bottom plate 5 of the free standing golf club apparatus. Sod penetrating prongs 3*a*, and 3*c* are extended perpendicular to bottom plate 5, and sod penetrating prongs 3*b* and 3*d* are folded into a retracted position, parallel to bottom plate 5. The sod penetrating prongs in the design depicted in FIG. 4 are made of "C" shaped, channel type material. Each sod penetrating prong is pivotally attached to bottom plate 5, by a hinge 8. This could be a spring loaded, 90 degree, two position hinge. Each sod penetrating prong is mounted to bottom plate 5, within an indentation 9, formed into bottom plate 5. The sod penetrating prongs 3, when folded toward the bottom plate 5, are retracted into the indentations 9. The outer end of each indentation is such that it forms a 90 degree stop for the sod penetrating prong 3 mounted within that indentation. An inward swell 10 is formed to the top edge of each side of each indentation. These inward swells 10 provide a snap open, and snap closed mechanism for each sod penetrating prong 3.

Figure 5:
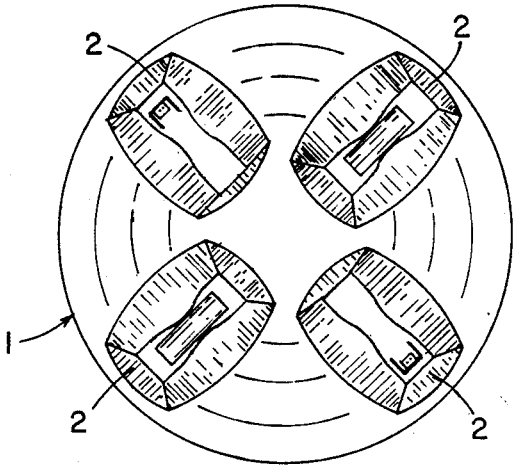
FIG. 5 is a bottom elevation of a golf club bag equipped with 4, single prong golf club bag apparatus.

Referring to FIG. 5, it can be seen that the golf club bag 1 depicted in this drawing is equipped with a plurality of single prong support apparatus 2.

I claim:

1. A tubular golf club container with a means for supporting said container in a vertical position, said means comprising a chassis, said chassis further comprising a generally round disk having an upper and lower side, and a plurality of sod penetrating prongs, each having a top and bottom end, said top end being hinged to said lower side of said disk as to allow a 90 degree swing from a adjacent and parallel to said disk, to downward and perpendicular to said disk, wherein, said chassis further comprises a plurality of indentations within said lower side of said disk, said sod penetrating prongs being hinged to said lower side of said disk within said indentations as to facilitate being folded into a retracted position within said indentations.

2. A tubular golf club container with a means for supporting said container in a vertical position, said means comprising a chassis, said chassis further comprising a generally round disk having an upper and lower side, and a plurality of sod penetrating prongs, each having a top and bottom end, and a means for suitably affixing said top end of said sod penetrating prongs to said lower side of said disk, wherein, said chassis further comprises a plurality of indentations, said indentations each having two parallel, essentially vertical sides, said means for suitably affixing said sod penetrating prongs to said chassis further comprising a resilient spring rod, said rod having two ends, said rod passing through said top end of said sod penetrating prongs, and said ends of said rod being seated into said sides of said indentations so as to facilitate folding said sod penetrating prongs in and out of said indentations, and maintaining the position of said sod penetrating prongs at a 90 degree position relative to said disk through spring tension exerted between said top end of said sod penetrating prong, and said lower side of said disk, by said rod.

3. A tubular golf club container with a means for supporting said container in a vertical position, said means comprising a chassis, said chassis further comprising a generally round disk having an upper and lower side, and a plurality of sod penetrating prongs, each having a top and bottom end, and a means for suitably affixing said top end of said sod penetrating prongs to said lower side of said disk, wherein, said chassis further comprises a plurality of indentations, each said indentation having two parallel, essentially vertical sides, an inner end, and an outer end, each said top end of said sod penetrating prongs being hinged within each said indentation adjacent to said outer end, said outer end thus forming a 90 degree stop element for each said sod penetrating prong, each said parallel side further comprising an inward swell, said inward swell so positioned as to exert friction upon said sod penetrating prong while folding so as to form a snap retainer mechanism for opened and closed positions of said sod penetrating prong.

4. An apparatus for supporting and maintaining a golf club bag in a vertical position on natural turf comprising a chassis, said chassis further comprising a generally round disk, said disk having an upper and a lower side, a means for suitably affixing said chassis to said golf club bag, and a plurality of spike like, sod penetrating prongs, each having a top and bottom end, said top end being pivotally attached to said lower side of said disk as to allow said sod penetrating prongs to be folded from a position perpendicular to said disk to a position parallel to said disk, wherein, said chassis further comprises a plurality of indentations formed within said lower side of said disk, said top ends of said sod penetrating prongs being suitably attached to said lower side of said disk as to allow said sod penetrating prongs to be folded to a position within said indentations.

5. An apparatus as recited in claim 4, wherein said indentations comprise two parallel, essentially vertical sides, and wherein said means for securing said chassis to said turf further comprise a polarity of resilient spring rods, each said rod having two ends, said rod passing through said top end of said sod penetrating prong, and said ends of said rod being seated into said sides of said indentations so as to facilitate folding said sod penetrating prongs in and out of said indentations, and maintaining the position of said sod penetrating prongs at 90 degree positions through spring tension exerted between said top ends of said sod penetrating prongs, and said lower side of said disk by said rod.

6. An apparatus for supporting and maintaining a golf club bag in a vertical position on natural turf comprising a chassis, said chassis further comprising a generally round disk, said disk having an upper and a lower side, a means for suitably affixing said chassis to said golf club bag, and a plurality of spike like, sod penetrating prongs, each having a top and bottom end, said top end being pivotally attached to said lower side of said disk as to allow said sod penetrating prongs to be folded from a position perpendicular to said disk to a position parallel to said disk, wherein, said chassis further comprises a plurality of indentations, each said indentation having to parallel, essentially vertical sides, an inner end, and an outer end, said top end of each said sod penetrating prong being hinged within said indentation adjacent to said outer end, said outer thus forming a 90 degree stop element for said sod penetrating prong, each said parallel side further comprising an inward swell, said inward swells so positioned as to exert friction upon said sod penetrating prong while folding so as to form a snap open, and closed mechanism for each said sod penetrating prongs.

7. A golf club bag as recited in claim 6, wherein said sod penetrating prongs comprise tapered channel shaped material.

8. An apparatus as recited in claim 4, wherein said golf club bag has a top end, and a bottom end, and wherein said means for suitably affixing said chassis to said golf club bag comprises a collar, said collar suitably attached to said upper side of said disk, said collar having a top and bottom end, said bottom end of said collar being larger in diameter than said bottom end of said golf club bag, said top end of said collar being smaller in diameter than said bottom end, said top end being elastic, thus allowing said top end of said collar to hug said bottom end of said golf club bag

9. An apparatus as recited in claim 4, wherein said chassis is generally rectangular, each chassis being equipped with a single spike like, sod penetrating prong, thus allowing said golf club bag to be equipped with a plurality of said chassis.

* * * * *